United States Patent [19]

Aronsson

[11] Patent Number: 4,534,431

[45] Date of Patent: Aug. 13, 1985

[54] SUPPORTING FEEDER ASSEMBLY FOR MATERIAL HANDLING MACHINES

[76] Inventor: Bo Aronsson, Kyrkogatan 36, S-579 00 Högsby, Sweden

[21] Appl. No.: 594,132

[22] Filed: Mar. 28, 1984

[30] Foreign Application Priority Data

Apr. 8, 1983 [SE] Sweden ..... 8301962

[51] Int. Cl.[3] ..... B62D 57/02

[52] U.S. Cl. ..... 180/9; 180/8.5; 180/8.6

[58] Field of Search ..... 180/8.1, 8.5, 8.6, 9

[56] References Cited

U.S. PATENT DOCUMENTS

| | | | |
|---|---|---|---|
| 1,086,466 | 2/1914 | Rood | 180/9 |
| 2,132,184 | 10/1938 | Poche | 180/8.5 |
| 3,034,591 | 5/1962 | Bell | 180/8.6 |
| 3,765,499 | 10/1973 | Harmala | 180/8.6 |
| 4,401,408 | 8/1983 | Gibert | 180/8.5 |

FOREIGN PATENT DOCUMENTS

| | | | |
|---|---|---|---|
| 1444566 | 5/1966 | France | 180/9 |

*Primary Examiner*—Ronald B. Cox

*Attorney, Agent, or Firm*—Sughrue, Mion, Zinn, Macpeak and Seas

[57] ABSTRACT

A supporting feeder assembly for material handling machines primarily for use on soft ground when the material handling machine fastens. The feeder assembly comprises an elongate beam unit secured to the implement mount of the material handling machine disposed at the front of said machine. A carriage can move along the beam unit either by rolling freely or by positive displacement and supports a carrier assembly. If the front wheels of the material handling machine fasten the driver can raise them from the ground by lowering the implement mount and can drive the machine forward by means of the larger rear wheels or with the aid of an implement disposed at the rear of the machine, for example a digging bucket, as the carrier assembly engages the ground and the material handling machine moves forward in consequence of the beam unit running on the carriage. When the machine reaches its foremost position the driver can lower the front wheels and then repeat the entire cycle until the front wheels reach solid ground.

10 Claims, 4 Drawing Figures

SUPPORTING FEEDER ASSEMBLY FOR MATERIAL HANDLING MACHINES

BACKGROUND OF THE INVENTION

1. Field of the Invention

The present invention refers to a supporting feeder assembly for material handling machines.

2. Description of the Prior Art

In wheel-carried material handling machines, for instance digging machines, problems can arise when the machine is to run on a soft base of the type of mossland and similar, for example in ditch-digging or peat-digging. In this case it can namely occur that the machine fastens with its wheels, particularly the front wheels, which frequently have smaller dimensions than the back wheels. In order to release a machine which has become impeded in this manner a substantial amount of both people and auxiliary machines may be necessary.

SUMMARY OF THE INVENTION

The present invention has the object of obviating this problem, and the means by which this is done are set forth in the accompanying claims.

BRIEF DESCRIPTION OF THE DRAWINGS

The invention will be described more specifically in the following with reference to the accompanying drawing, in which.

DESCRIPTION OF THE PREFERRED EMBODIMENT

Figures 1, 2, 3, 4:
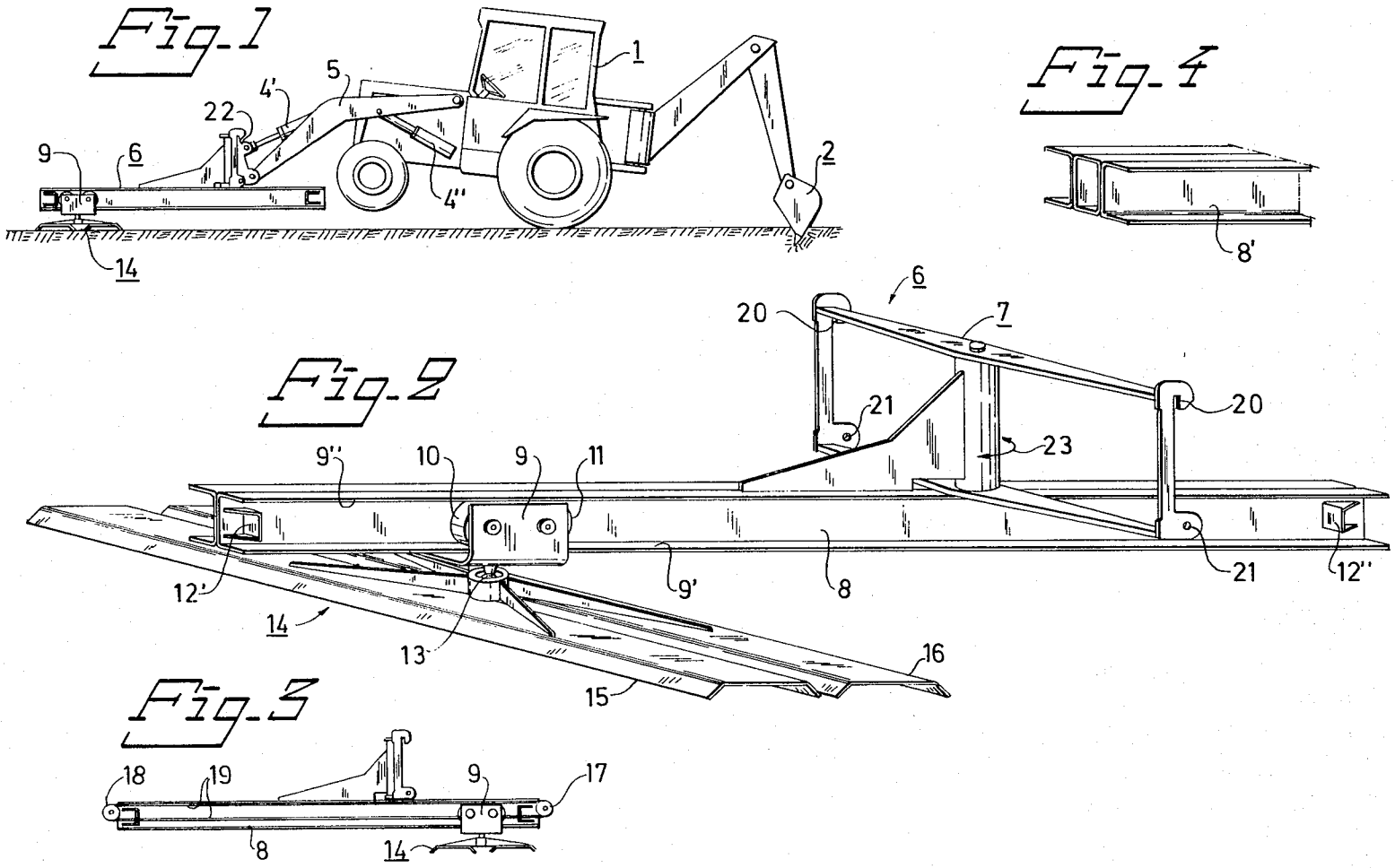
FIG. 1 is a lateral view showing a supporting feeder assembly in accordance with the invention mounted on a material handling machine and in operation, with the front wheels of the material handling machine being in lifted position.
FIG. 2 is an enlarged perspective view of the supporting feeder assembly per se detached from the material handling machine.
FIG. 3 is a side view on a smaller scale of a modified feeder assembly in which the support assembly intended for engaging the ground is located at the opposite end of the beam unit as compared to FIGS. 1 and 2.
FIG. 4 is a perspective view which shows another possible embodiment of the beam than the one utilized in FIGS. 1–3. The same reference numerals have been used in the different figures wherever possible.

In FIG. 1 the designation 1 refers to a material handling machine chosen as an example and being provided with a digging bucket 2 disposed at the rear, it being possible to provide said machine with a desired implement at the front attached to an implement mount comprising a bracket 22 which is pivotal and may be raised and lowered by means of two hydraulic cylinders actuating the upper part of the bracket 22, only one, 4', of said cylinders being illustrated, and by means of two arms 5 which may be raised and lowered each by its hydraulic cylinder 4'' (only one hydraulic cylinder 4'' and one arm 5, respectively, are shown; the other ones are located at the opposite side of the material handling machine). A work implement is generally mounted on the implement mount, for example a load bucket or forks, but in this example it is assumed that the intention right out from the start is to use the material handling machine on soft ground in which there is a danger of the front wheels fastening, and for this reason a feeder assembly 6 in accordance with the invention is mounted to the implement mount.

The feeder assembly 6 is shown more specifically in FIG. 2 and comprises a four point mount 7 disposed for cooperation with the implement mount of the material handling machine, with an elongate beam unit 8 being secured to said four point mount, said beam unit in the illustrated case being formed of two channel irons interconnected back to back. A carriage 9 can run in the longitudinal direction of the beam unit, said carriage being provided with wheels 10, 11 running between flanges 9' and 9'' on one side of the beam unit and with corresponding wheels (not shown) on the other side of the beam unit. At the ends of the beam unit there are stops 12' and 12'', respectively, for preventing the carriage 9 from sliding off the beam unit.

A connection 13 which in FIG. 2 is shown as a ball joint but which alternatively may consist of a stationary mount supports a carrier assembly 14 intended for engaging the ground, said assembly in the present embodiment consisting of two profiled plates 15 and 16, respectively. These profiled plates are illustrated with their longitudinal directions at right angles to the longitudinal direction of the beam unit but they are not limited to the illustrated embodiment and the illustrated position, respectively, and they can for example consist of one single plate or a plurality of other appropriate members than the profiled plates 15 and 16. The carrier assembly 14 is intended to engage the ground, and the main thing is that it provides a good and large engagement surface against the ground and furthermore enables release with respect to the ground when the carrier assembly is to be lifted up. Its function will be disclosed more in detail below.

The beam unit 8 can either be pivotal with respect to the four point mount 7, as is marked out by means of arrow 23, or alternatively it can be rigidly connected to mount 7.

In the embodiment of FIG. 2 the carriage 9 can be made to roll freely in the longitudinal direction of the beam unit on its wheels 10 and 11 and corresponding wheels on the opposite side of the beam unit by the beam unit being slanted in such manner that one or the other of its ends lies higher than the opposite end.

FIG. 3 shows another embodiment of the feeder assembly in which beam unit 8 is provided with rollers 17 and 18 at its ends. A cable or a chain 19 runs in a loop over rollers 17 and 18 and is secured to carriage 9, with carrier assembly 14 being operable by either of rollers 17 and 18 or both of these being driven by an appropriate motor, for example a hydraulic motor.

FIG. 4 shows a portion of a beam unit 8' having another profile than the above-mentioned beam units 8, viz. an intermediate beam with square or rectangular cross section and with the intermediate shanks of channel irons attached to individual ones of two vertical walls in said square or rectangular cross section.

The supporting feeder assembly in accordance with the invention operates in the following manner. Four point mount 7 is secured to a material handling machine in accordance with FIG. 1, i.e. by means of recesses 20 located at the top of the mount hooked onto the bracket 22 of the material handling machine with bolts being introduced through apertures 21 in the mount 7 and in the bracket 22. As long as the material handling machine can drive forwardly it holds its implement mount with the four point mount 7 positioned thereon and the associated beam unit 8 and carrier unit 14 lifted, and thus the feeder assembly will go free from the ground. If carriage 9 is embodied in the manner shown in FIG. 2, i.e. the wheels 10 and 11 can roll freely, the position of the feeder assembly along beam unit 8 will be dependent of if the front end or rear end thereof is lifted the highest, whereas in the embodiment of FIG. 3 it is possible to determine where carriage 9 is to be positioned along the beam unit by means of the motor drive of rollers 17 or 18.

If the material handling machine fastens with its front wheels its driver controls the implement mount of the machine in such manner that the front end of beam unit 8 will be positioned lower than its rear end, whereby in the case of beam unit 8 in accordance with FIG. 2 carriage 9 and its associated carrier assembly will be moved to the front end of the beam unit, i.e. the end located most remotely from the material handling machine, so that wheel 10 will engage stop 12'. If on the other hand carriage 9 is wire driven or chain driven in accordance with FIG. 3 the driver of the material handling machine operates the drive motor or drive motors for rollers 17 and 18 so that carriage 9 and its associated carrier assembly is fed to the front end of beam unit 8, i.e. the end which is located most remotely from the material handling machine.

When carrier assembly 14 now is positioned at the very front of beam unit 8 the driver of the material handling machine lowers feeder assembly 6 by means of the implement mount of the machine so as to urge carrier assembly 14 against the ground, thereby causing the front wheels of the material handling machine to be lifted so that the material handling machine substantially will take the position shown in FIG. 1. The driver of the material handling machine can now let the digging bucket 2 mounted at the rear of the material handling machine firmly engage the ground and push, whereby beam unit 8 will slide forwardly on rollers 10 and 11 and the corresponding rollers on the other side of the beam unit and the entire material handling machine thus will move forward until beam unit 8 has been moved so far in the forward direction that wheel 11 engages stop 12''. In the embodiment of FIG. 3 the hydraulic motor which drives rollers 17 and/or 18 may assist in pulling the material handling machine forwards along beam unit 8.

The driver of the material handling machine may thereafter lower the front wheels of the material handling machine by lifting up the implement mount, and with the material handling machine in this position digging can for example be carried out with digging bucket 2, for instance to dig out a ditch which is to be dug up behind the material handling machine. When the material handling machine is to be moved forward again the same cycle as above is repeated.

The invention is not restricted to the embodiments illustrated above and shown in the drawing, and these are merely examples of the invention and its mode of utilization.

I claim:

1. A supporting feeder assembly for material handling machines, said assembly being adapted to be detachably secured to said machine, wherein said assembly comprises (a) one single elongate beam unit, said unit being disposed substantially centrally in the longitudinal direction of the machine, (b) a carraige, said carriage being supported by said beam unit and being capable of running along the beam unit in the longitudinal direction thereof, and (c) a carrier assembly, said carrier assembly being connected to said carriage for engaging a substrate such as the ground.

2. A feeder assembly in accordance with claim 1, wherein said carriage is adapted to roll freely in the beam unit.

3. A feeder assembly in accordance with claim 1, wherein said carriage is adapted to be driven in the beam unit by means of a cable.

4. A feeder assembly in accordance with claim 1, wherein said carriage is adapted to be driven in the beam unit by means of a chain.

5. A feeder assembly in accordance with claim 1, wherein said carrier assembly is attached to said carriage by means of a pivotal mount.

6. A feeder device in accordance with claim 1, wherein said carrier assembly is attached to said carriage by means of a stationary mount.

7. A feeder assembly in accordance with claim 1, wherein said beam unit is composed of two channel irons which are interconnected back to back.

8. A feeder assembly in accordance with claim 1, wherein said beam unit is formed of an intermediate beam having a square cross section and with the intermediate shanks of channel irons being attached to each one of two vertical walls in said square cross section.

9. A feeder assembly in accordance with claim 1, wherein said beam unit is formed of an intermediate beam having a rectangular cross section and with the intermediate shanks of channel irons being attached to each one of two vertical walls in said rectangular cross section.

10. A feeder device in accordance with claim 1, wherein said carrier assembly comprises a carrier plate unit.

* * * * *